US006496084B1

(12) United States Patent
Monte et al.

(10) Patent No.: US 6,496,084 B1
(45) Date of Patent: Dec. 17, 2002

(54) SPLIT ORTHO-MODE TRANSDUCER WITH HIGH ISOLATION BETWEEN PORTS

(75) Inventors: Thomas D. Monte, Lockport, IL (US); Ronald J. Brandau, Lockport, IL (US)

(73) Assignee: Andrew Corporation, Orlando Park, IL (US)

( * ) Notice: Subject to any disclaimer, the term of this patent is extended or adjusted under 35 U.S.C. 154(b) by 0 days.

(21) Appl. No.: 09/925,752

(22) Filed: Aug. 9, 2001

(51) Int. Cl.[7] ..... H01P 5/12

(52) U.S. Cl. ..... 333/121; 333/125; 333/137; 333/21 A

(58) Field of Search ..... 333/121, 125, 333/137, 21 A

(56) References Cited

U.S. PATENT DOCUMENTS

| | | | | |
|---|---|---|---|---|
| 2,730,677 A | | 1/1956 | Boissinot et al. | 333/21 |
| 2,766,430 A | | 10/1956 | Zaleski | 333/7 |
| 3,670,268 A | | 6/1972 | Connerney | 333/11 |
| 3,946,339 A | | 3/1976 | Oltman, Jr. et al. | 333/11 |
| 4,047,128 A | | 9/1977 | Morz | 333/11 |
| 4,074,265 A | | 2/1978 | True | 343/18 |
| 4,176,330 A | | 11/1979 | DeTullio et al. | 333/122 |
| 4,302,733 A | | 11/1981 | Salzberg | 333/101 |
| 4,413,242 A | | 11/1983 | Reeves et al. | 333/122 |
| 4,420,756 A | * | 12/1983 | Hamada et al. | 333/122 |
| 4,516,089 A | | 5/1985 | Goscianski et al. | 333/135 |
| 4,833,429 A | | 5/1989 | Keren et al. | 333/156 |
| 4,849,761 A | | 7/1989 | Thomas | 342/153 |
| 5,066,959 A | | 11/1991 | Huder | 343/786 |
| 5,075,647 A | | 12/1991 | Petter | 333/121 |
| 5,243,306 A | | 9/1993 | Minowa et al. | 333/135 |
| 5,329,285 A | * | 7/1994 | McCandless | 333/115 |
| 5,392,008 A | | 2/1995 | Wong | 333/21 |
| 5,576,670 A | | 11/1996 | Suzuki et al. | 333/126 |
| 6,031,434 A | | 2/2000 | Tatomir et al. | 333/126 |
| 6,087,908 A | * | 7/2000 | Haller et al. | 333/122 |
| 6,225,875 B1 | | 5/2001 | Kich | 333/125 |

* cited by examiner

*Primary Examiner*—Michael Tokar
*Assistant Examiner*—Linh Van Nguyen
(74) *Attorney, Agent, or Firm*—Jenkens & Gilchrist

(57) ABSTRACT

An ortho-mode transducer has a common port having a longitudinal axis, a single-polarized back port having a longitudinal axis, a transition element connecting the common port and the single-polarized back port, the longitudinal axis of the single-polarized back port being substantially aligned with the longitudinal axis of the common port; a single-polarized side port, and a hybrid tee waveguide junction connecting the single-polarized side port to the transition element. The hybrid tee waveguide junction includes a balanced pair of side arm waveguides connecting the single-polarized side port to the transition element. The ortho-mode transducer prevents the generation of higher order modes, and ensures high isolation in a compact three-dimensional profile.

24 Claims, 4 Drawing Sheets

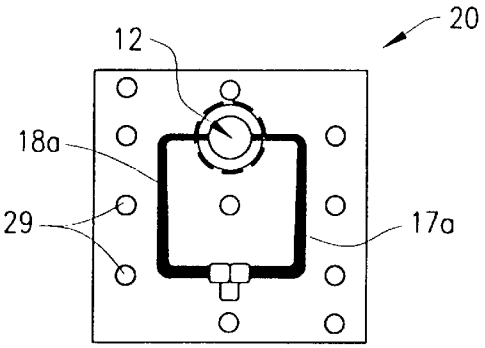
FIG. 2
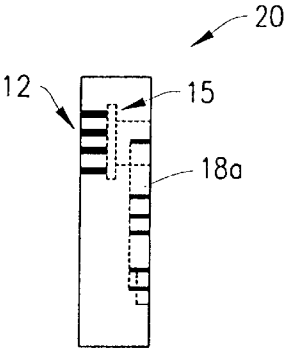
FIG. 3
FIG. 4
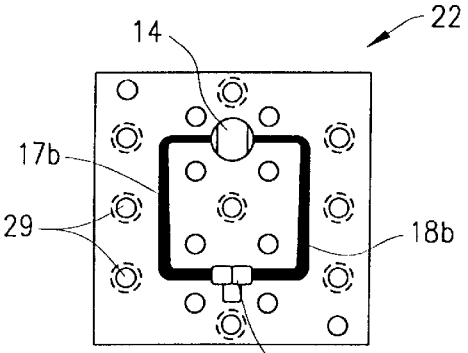
FIG. 5
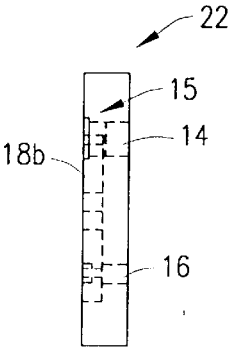
FIG. 6
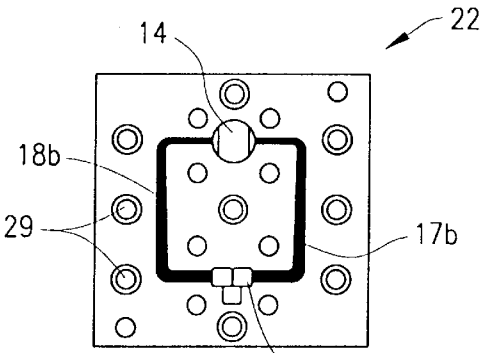
FIG. 7

SPLIT ORTHO-MODE TRANSDUCER WITH HIGH ISOLATION BETWEEN PORTS

FIELD OF THE INVENTION

The present invention relates generally to the field of ortho-mode transducers, and, more particularly, but not by way of limitation, to an ortho-mode transducer that includes a hybrid tee waveguide junction connected to a single-polarized port of the transducer.

BACKGROUND OF THE INVENTION

Ortho-mode transducers (OMTs) are commonly used in communications systems because of their ability to provide for a concurrent transmission of signals of differing frequencies and differing polarizations. As such, an OMT is an important waveguide device in dual polarized reflector and horn antenna systems.

An OMT is a three-port waveguide device that supports signals having two orthogonal modes; for example, a vertically polarized mode (V-mode) and a horizontally polarized mode (H-mode). The OMT includes a common port that supports both H-polarized and V-polarized signals, a through or back port that is axially aligned with the common port and supports only V-polarized signals, and a side port that supports only H-polarized signals.

An OMT is frequently used to separate H-polarized and V-polarized signals from a combined signal. For example, a combined signal can be received from a parabolic reflector or the like, and applied to the common port through a feed horn. The combined received signal is separated by the OMT into separate V-polarized and H-polarized signals that are output via the back and side ports, respectively. An OMT is also used in applications in which the back and side ports function as input ports and the common port functions as an output port. For example, the input ports can be coupled to sources of electromagnetic radiation and the common output port can be coupled to a receiver. Yet further, an OMT can be used in applications in which both transmitted and received signals are simultaneously guided through the OMT. For example, V-polarized signals can be transmitted and H-polarized signals can be received.

A survey of OMT technology is provided in the publication: Uher, et al, "Waveguide Components for Antenna Feed Systems: Theory and CAD", Artech House, Norwood, Mass., Section 3.8, 1993. In this survey, various narrowband OMTs are categorized into four basic design types including taper/branching, septum/branching, acute angle or longitudinal ortho-mode branching, and short-circuited common waveguide design types. Various broadband OMT designs are also discussed and are categorized into two main types including distinct dual junction and equal dual junction types.

Exemplary OMT transducers are set forth and described in U.S. Pat. Nos. 4,176,330; 5,392,008; 6,031,434 and 6,225,875. A further example of an OMT transducer is described in U.S. Pat. No. 6,087,908 wherein a planar OMT is constructed with the H and V ports both lying in a plane. The plane is substantially orthogonal to the common port. The common waveguide is terminated in an appropriately placed short which forces the energy into the H and V ports.

Also known in the art are OMTs that are often referred to as "split" OMTs. A split OMT is an OMT that is assembled from two, separately manufactured parts or halves. In particular, the manufacture of an OMT involves the precise assembly of a variety of elements; and, as a result, the manufacture of an OMT as a single component is often quite difficult and costly. In a split OMT, on the other hand, the OMT is constructed from two halves that are separately manufactured and that are designed to be symmetrical with respect to their longitudinal plane of assembly so that the halves may be easily assembled into a finished OMT. The separate halves are capable of being manufactured using common industrial processes such as machining, casting or molding; and, thus, are usually easier and less costly to manufacture. Also, because the halves can be manufactured using common processes, split OMTs are usually capable of being produced on a considerably larger scale than one-piece OMTs.

A discussion of split OMTs is provided in the publication: M. Ludovico, et al, "CAD and Optimization of Compact Ortho-mode Transducers", *IEEE Trans. Microwave Theory and Techniques,* December 1999, pp 2479–2485. In addition, various split OMTs and other waveguide components are described in U.S. Pat. Nos. 4,516,089; 5,243,306 and 5,576,670. In U.S. Pat. No. 4,516,089, for example, a waveguide device is described that is constructed from two half shells which are symmetrical with respect to a longitudinal plane of the device and that are assembled together using attachment screws. U.S. Pat. No. 5,243,306 describes a branching filter which comprises a transmit filter, a waveguide branching filter and a receive filter. Each of the filters are divided into first and second parts, and various ones of the parts are formed integral with other parts so as to facilitate manufacture of the branching filter. U.S. Pat. No. 5,576,670 describes a known branching filter for a transmitter-receiver that is constructed in three parts that are detachably connected together to provide the device.

Various other waveguide devices and components are described in U.S. Pat. Nos. 2,730,677; 2,766,430; 3,670,268; 4,047,128; 4,074,265; 4,302,733; 4,413,242; 4,420,756; 4,849,761; 5,066,959 and 5,075,647. Several of these patents, for example, U.S. Pat. Nos. 2,766,430; 3,670,268 and 4,413,242, describe a waveguide device that is sometimes referred to as a hybrid tee waveguide junction or a "magic tee waveguide", while others of the patents, for example, U.S. Pat. Nos. 4,420,756; 4,489,761 and 5,066,959, describe various systems that incorporate such a device. Hybrid tee waveguide junctions are frequently used as power dividers or power combiners and will be described in greater detail hereinafter.

Known OMTs are not fully satisfactory for a number of reasons. For example, some OMT designs are not fully effective in preventing the generation of undesirable higher order modes. Other OMT designs do not provide a sufficiently high isolation between the side and back ports, particularly those OMT designs that endeavor to provide a compact construction. Yet other designs, as indicated above, are difficult to manufacture and are thus relatively expensive.

It would be a distinct advantage, therefore, to provide an OMT that is compact and low in cost and that also provides a high degree of isolation, excellent mode purity and acceptable return loss levels.

BRIEF DESCRIPTION OF THE DRAWINGS

The foregoing and other advantages of the invention will become apparent upon reading the following detailed description, when taken in conjunction with the accompanied drawings, wherein:

FIG. 2 is a top plan view of the top half of the ortho-mode transducer of FIG. 1;

FIG. 3 is a side plan view of the top half of the ortho-mode transducer of FIG. 1;

FIG. 4 is a rear plan view of the top half of the ortho-mode transducer of FIG. 1;

FIG. 5 is a top plan view of the bottom half of the ortho-mode transducer of FIG. 1;

FIG. 6 is a side plan view of the bottom half of the ortho-mode transducer of FIG. 1;

FIG. 7 is a rear plan view of the bottom half of the ortho-mode transducer of FIG. 1;

DESCRIPTION OF ILLUSTRATIVE EMBODIMENTS

It has been discovered that an ortho-mode transducer in which a hybrid tee waveguide junction connects the single-polarized side port to a transition element that connects the common port and the single-polarized back port, can be constructed that is compact and low in cost and that prevents the generation of undesirable higher order modes and ensures very high isolation between the side and back ports.

According to one embodiment of the invention, the single-polarized side port comprises the in-phase port of a hybrid tee waveguide junction, i.e., a "magic tee waveguide"; and the balanced side arms of the hybrid tee waveguide junction are looped around and connected to the transition element as a symmetrical structure to feed the transition element so as to provide, in conjunction with the back port, an orthogonal polarization signal in the common port. The OMT may be constructed in two separately manufactured halves that may be assembled to provide a complete OMT that can be manufactured at a low cost as will be set forth in more detail below.

Figure 1:
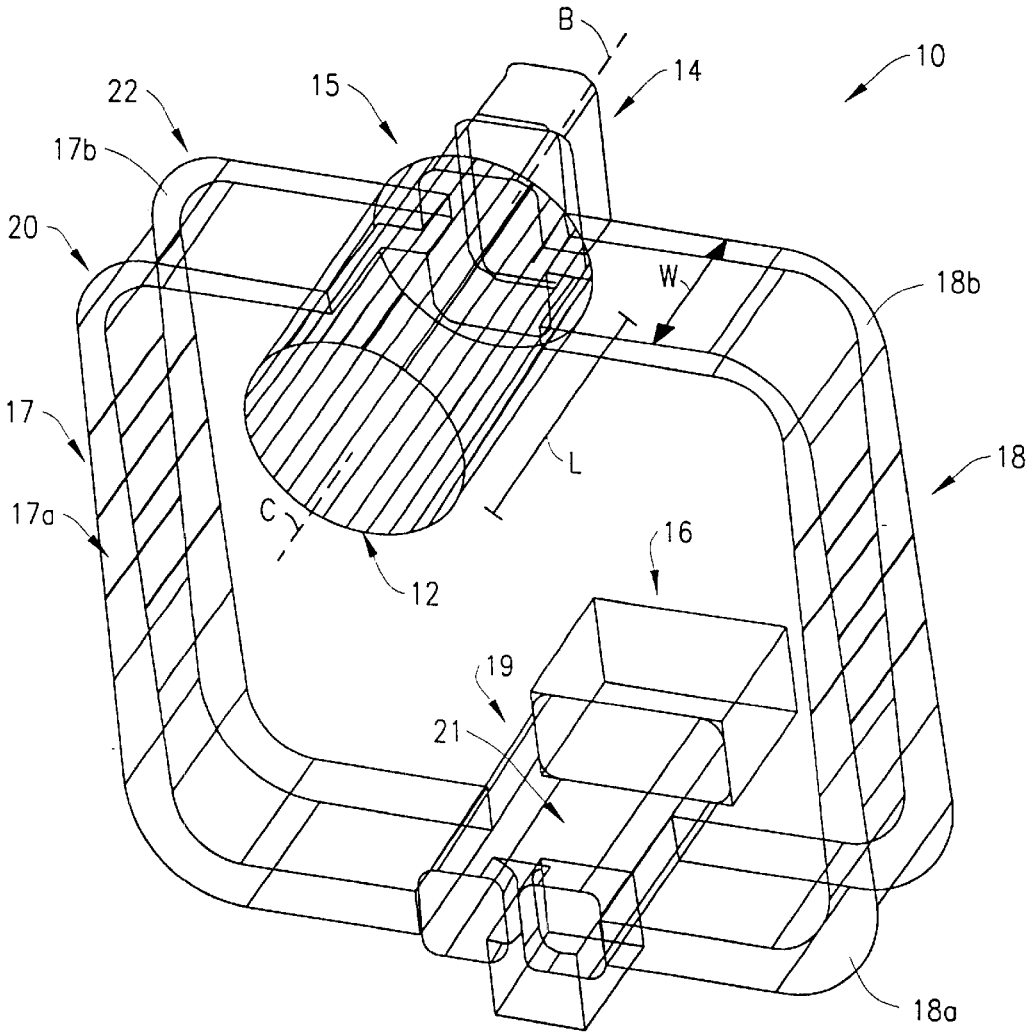
FIG. 1 is a perspective view of an embodiment of an ortho-mode transducer constructed in accordance with principles of the present invention.

The present invention will now be described in connection with the embodiments shown in the drawings. Referring first to FIG. 1, there is shown an OMT 10 according to one embodiment of the invention. Reference is also made to FIGS. 2–7 which comprise top, side and rear views of top and bottom halves of OMT 10 as will be explained more fully hereinafter. In the illustrated embodiment, OMT 10 includes a common port 12, a single-polarized back port 14 and a single-polarized side port 16. Common port 12 comprises a port having a common port axis C and is capable of carrying two orthogonally polarized signals, frequently designated as V-polarized and H-polarized signals. Although in the embodiment of FIG. 1, common port 12 is of circular shape, this is intended to be exemplary only. The port could also be square or of another suitable shape as is known to those skilled in the art.

Still referring to FIG. 1, the back port 14 is sized and configured to pass signals of a single given polarity; i.e. V-polarized signals. The axis B of back port 14 is directly aligned with the axis C of the common port 12; and, as best shown in FIG. 7, back port 14 is of a generally rectangular shape. Common port 12 and back port 14 are connected by a transition element, generally designated by reference number 15. As shown in FIGS. 1, 3 and 6, the transition element 15 provides a transition from the rectangular-shaped back port 14 to the circular-shaped common port 12. The transition element is designed such that this transition is sufficiently gradual to provide a minimum return loss of its dominant signal, i.e, the V-polarized signal; and, at the same time, is sufficiently abrupt to reflect the opposite polarity signal, i. e., the H-polarized signal fed by the side port.

Still referring to FIG. 1, single-polarized side port 16 is of generally rectangular shape and is configured to pass signals of a single given polarity orthogonal to the polarity of the signals passed by the back port, i.e., H-polarized signals. As will be explained more fully hereinafter, side port 16 is connected to the transition element 15 by a connecting waveguide structure that comprises a hybrid tee waveguide junction or "magic tee waveguide" 19 that includes a balanced pair of side arms 17 and 18.

As is known to those skilled in the art, common port 12 of an OMT can function as an input port and the back and side ports 14 and 16 can function as output ports. In such a mode of operation, the common port 12 can receive combined V-polarized and H-polarized signals from, for example, a parabolic reflector or another source; and the back and side ports 14 and 16 will transmit only V-polarized and H-polarized signals, respectively. Alternatively, the back and side ports 14 and 16 can function as input ports coupled, for example, to sources of electromagnetic energy, and the common port 12 can function as an output port. In addition, the OMT can be used in applications in which signals are both transmitted and received, for example, V-polarized signals are received and H-polarized signals are transmitted.

Referring now to FIGS. 2–7 in combination, OMT 10 is preferably manufactured in two separate halves or sections; and, thus, preferably comprises a split OMT. More particularly, OMT 10 includes a top half 20, illustrated in FIGS. 2–4 in combination, and a bottom half 22, illustrated in FIGS. 5–7, in combination.

Referring specifically to FIG. 2, there is shown a top plan view of top half 20 of OMT 10 that illustrates the common port 12, portions 17*a* and 18*a* of balanced side arms 17 and 18 and a plurality of apertures 29 which extend through the OMT for receiving threaded members such as bolt 30.

Referring specifically to FIG. 3, there is shown a side plan view of top half 20 of OMT 10 that illustrates the common port 12, balanced side arm portion 18*a* of balanced side arm 18 and a portion of transition element 15.

Referring specifically to FIG. 4, there is shown a rear plan view of top half 20 of OMT 10 that illustrates the common port 12, balanced side arm portions 17*a* and 18*a* and apertures 29.

Referring specifically to FIG. 5, there is shown a top plan view of the bottom half 22 of OMT 10 that illustrates the single-polarized back port 14 and the single side-polarized side port 16. In addition, FIG. 5 illustrates portions 17*b* and 18*b* of the balanced side arms 17 and 18, and the apertures 29.

Referring specifically to FIG. 6, there is shown a side plan view of the bottom half 22 of OMT 10 to illustrate the single-polarized back and side ports 14 and 16, portion 18*b* of balanced side arm 18 and a portion of the transition element 15.

Referring specifically to FIG. 7, there is shown a rear plan view of bottom half 22 of OMT 10 that illustrates the single-polarized back and side ports 14 and 16, the portions 17*b* and 18b of balanced side arms 17 and 18, and the plurality of apertures 29.

As illustrated in FIG. 1 and in FIGS. 2–7, in combination, the common port 12 is built onto the top half 20, and the single-polarized back and side ports 14 and 16 are built onto the bottom half 22 of OMT 10. In addition, the balanced side arms 17 and 18 of the hybrid tee waveguide junction 19 are split between the top and bottom halves with half of the balanced side arms 17*a* and 18*a* built into the top half 20 of the OMT and the other half of the balanced side arms 17*b* and 18*b* built into the bottom half 22 of the OMT.

By constructing the OMT 10 in two halves, intricate mechanical features of the device, for example, features used for electrical tuning, can be formed in each half utilizing conventional manufacturing processes such as machining, casting or molding. As a result, the OMT 10 can be more easily manufactured at a relatively low cost. It should be understood, however, that it is not intended to limit the OMT of the present invention to a split OMT, as the OMT can be manufactured in other ways without departing from the spirit and scope of the present invention.

As shown in FIGS. 2, 4, 6 and 7, the two halves 20 and 22 are adapted to be assembled together by a plurality of threaded fasteners such as bolts or the like, one of which is illustrated at 30 in FIG. 2, inserted into aligned apertures 29 formed in the two halves.

As discussed previously with reference to FIG. 1, the single-polarized side port 16 of OMT 10 of the present invention is connected to the transition element 15 that connects the common port and the single-polarized back port with a hybrid tee waveguide junction structure 19. Hybrid tee waveguide junctions have been used in microwave systems for many years and are well-known in the art. Such structures are characterized as comprising four-part devices that include a first section, referred to as an H-arm, and two side sections, referred to as balanced side arms, joined together at a junction to define a structure generally in the shape of a tee. A fourth section, referred to as an E-arm is also provided and is also joined to the balanced side arms at a junction such that the E-arm also defines a tee-shaped structure with the side arms.

A properly constructed hybrid tee waveguide junction is electrically symmetrical and has unique properties. In particular, power applied to either the H-arm or the E-arm will be divided equally between the two, identically terminated balanced side arms. Alternatively, the vector sum of signals applied to each sidearm may be produced at the H-arm and the vector difference of signals applied to each side arm may be produced at the E-arm. Thus, when a signal is fed to the H-arm, the electrical field in the two side arms are in-phase at points equal distances from their junction. On the other hand, if the power is applied to the E-arm, the electrical fields in the two arms will be 180 degrees out of phase at points equal distances from their junction.

Hybrid tee waveguide junctions are used in various microwave applications including applications in which it is desired to generate sum and difference signals such as in monopulse radar systems. The present invention connects the single-polarized side port 16 of the OMT 10 of the present invention to the transition element 15 that connects the common port 12 and the single-polarization back port 14, and utilizes the unique properties of a hybrid tee waveguide junction to provide an OMT that prevents the generation of undesirable higher order modes in the common port and that maintains excellent isolation between the two single-polarization ports.

Referring in particular back to FIG. 1, in OMT 10, the side port 16 comprises the in-phase port of the hybrid tee, i.e., the H-arm of the hybrid tee. The H-arm and the E-arm of the hybrid tee, which is not used, is incorporated in a power divider structure generally designated by reference number 21, which extends from the single-polarized side port 16. The balanced side arms 17 and 18 of the hybrid tee extend perpendicularly from the sides of the power divider structure 21, and are looped around in symmetrical loops and connected to opposite sides of the transition element 15 to feed the transition element. As illustrated in FIG. 1, the width (W) of the balanced side arms along the direction of the longitudinal axis C of the common port is less than the length (L) of the transition element along the direction of the longitudinal axis of the common port. When a single-polarized signal is applied to the single-polarized side port 16, the signal feeds to the transition element 15 via the balanced side arms 17 and 18 of the hybrid tee waveguide junction 19, and that signal is combined with the single-polarization signal from the back port 14 to provide the orthogonal polarization signal in the common port 12.

Because the balanced side arms of the hybrid tee are looped around to the transition element in a symmetrical manner, the generation of undesirable higher order modes is prevented. If, for example, the basic structure is circular or quasi-circular as illustrated in FIG. 1, the balanced feeding prevents the generation of the TM01 and TE21 modes. If the general structure is square or nearly square, the balanced scheme prevents the generation of the TE11, TM11 and TE20 modes. In addition, as best shown in FIGS. 1, 2, 4, 5 and 7, the height of the balanced side arms 17 and 18 gradually decrease as they extend from the dividing structure 21 to the transition element 15 from a "full height" to a "half height" to minimize return losses.

An OMT according to the present invention allows for a circular common port that is relatively large in size since the back and side port signal paths are symmetrical. The larger circular common port implies that the OMT can be shorted since there is no need to transition to the larger size circular waveguide that is sometimes required at the antenna feed port. Furthermore, besides the pure generation of the desirable dominant modes in the common port; the design ensures very high isolation between the side and back ports in a compact three-dimensional profile. Since the back and side ports are oriented in the same plane as clearly shown in FIGS. 1 and 6, the relationship between the common port and the other ports is particularly convenient for integrated antenna and radio packages.

It may further be noted that the OMT design of the present invention does not require a septum for isolation purposes as required in many other designs; however, a septum can be captivated between the two halves of the OMT, if desired.

In order to establish the effectiveness of an OMT according to the present invention, designs have been modeled, built and tested. One design comprised an OMT for 7.125–7.750 GHz operation made from two machined halves assembled together to form the OMT. The overall dimensions of the OMT was 2.6 in. by 4.1 in. by 4.7 in. The two halves were formed such that the split of the balanced side arms was down the center of the wide dimension of the balanced side arms. Each machined half was approximately 1.3 in. by 4.1 in. by 4.7 in. The transition element extending from the back port functioned essentially as a shortened rectangular-to-circular transformer. The common port was balanced fed to better prevent moding problems or degrading XPD (Cross Polarization Discrimination). The design was modeled and adjusted with HFSS (High Frequency Structure Software).

Figure 8:
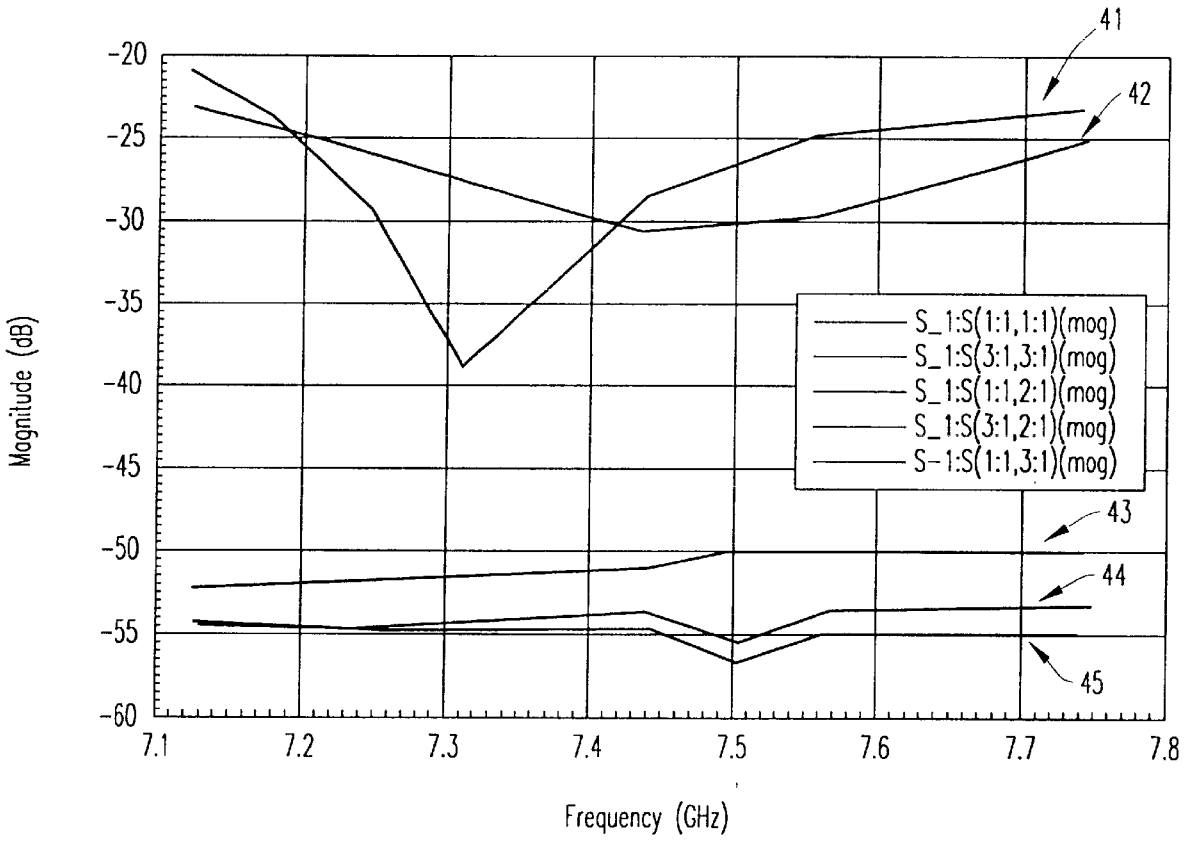
FIG. 8 is a graph summarizing the results of tests conducted on an ortho-mode transducer constructed in accordance with principles of the present invention.

Test measurements are summarized in Table 1 and in FIG. 8.

TABLE 1

| Port Designation | Return Loss (dB) | Insertion Loss (dB) | Port to Port Isolation w/load (dB) | Short Circuit Isolation (dB) |
|---|---|---|---|---|
| Common port | 20.2 | <0.15 | 65.0 | 62.0 |
| Back port | 21.2 | <0.10 | | |

Referring now to FIG. 8, there is shown a graph illustrating frequency (in GHz) versus magnitude (in dB). Graph line 41 represents the common port return loss, also set forth in Table 1. Graph line 42, which intersects graph line 41, represents the back port return loss, and graph line 43 shows the port-to-port isolation, which are also shown in Table 1. Graph line 44 shows the back port XPD, and graph line 45 shows the common port XPD.

A second design was also modeled, built and tested. This design of the split OMT was scaled to 27.5–31.3 GHz and the design was modeled and adjusted with HFSS. The design had overall dimensions of 2.25 in. by 4.0 in by 3.7 in. Each machined half was approximately 2.25 in. by 2.0 in by 3.7 in. Test results are summarized in Table 2.

TABLE 2

| Port Designation | Return Loss (dB) Measured | Return Loss (dB) Predicted | Port to Port Isolation (dB) Measured w/load (dB) | Port-to-Port Isolation (dB) Predicted (dB) |
|---|---|---|---|---|
| Common port | 17.3 | 19.0 | 55 | 57 |
| Back port | 20.4 | 21.0 | | |

The present invention thus provides a compact, low cost OMT that provides for the pure generation of desirable dominant modes in the common port while ensuring a high degree of isolation between the back and side ports. The design also allows a larger circular common port size since both the back and side port signal paths are symmetrical.

Figure 9:
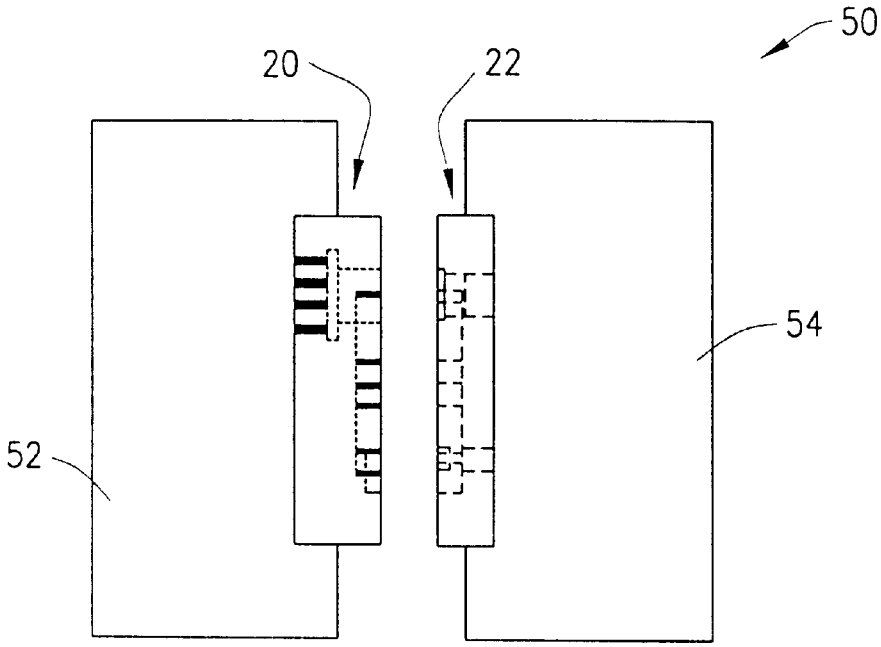
FIG. 9 schematically illustrates an apparatus comprising an antenna hub and a radio housing integrated with a split OMT in accordance with one embodiment of the present invention.

The OMT of the present invention can be used in numerous applications. By way of example only, there is shown in FIG. 9 a schematic illustration of an apparatus 50 that comprises a first component 52 integrated with the top half 20 of the OMT and a second component 54 integrated with the bottom half 22 of the OMT. The first component 52 can, for example, be an antenna hub to provide an input to the common port 12, and the second component 54 can be a radio housing to receive signals output from the OMT. Alternatively, the first component can be a radio housing and the second component can be an antenna hub. In general, components 52 and 54 can also comprise various types of components depending on the particular application in which the OMT is to be used.

Figure 10:
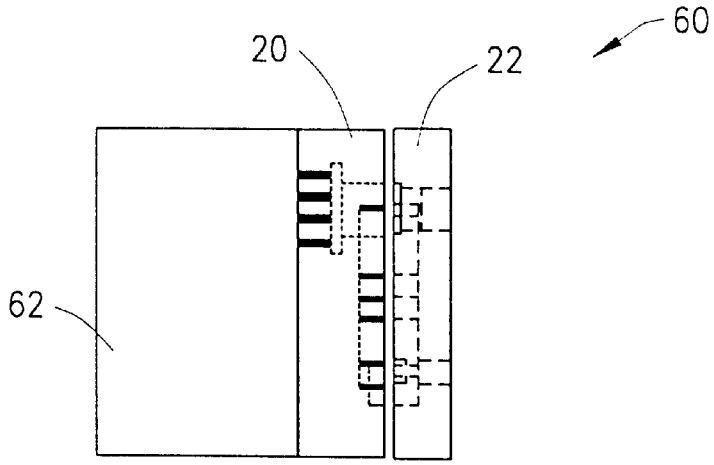
FIG. 10 schematically illustrates an apparatus comprising a feed horn radiator with an integrated split OMT in accordance with another embodiment of the present invention.

Referring now to FIG. 10, there is shown a schematic illustration of an apparatus 60 that includes a component 62, such as a feed horn radiator, integrated with the top half 20 of the split OMT 10 for radiating signals output by the OMT. In other applications, various components can be integrated with either the top half or the bottom half of the OMT Although preferred embodiment(s) of the present invention have been illustrated in the accompanying Drawings and described in the foregoing Description, it will be understood that the present invention is not limited to the embodiment (s) disclosed, but is capable of numerous rearrangements, modifications, and substitutions without departing from the spirit and scope of the present invention as set forth and defined by the following claims.

What is claimed is:

1. An ortho-mode transducer comprising:

a common port having a longitudinal axis;

a single-polarized back port having a longitudinal axis;

a transition element connecting said common port and said single-polarized back port, the longitudinal axis of said single-polarized back port being substantially aligned with the longitudinal axis of said common port;

a single-polarized side port; and a hybrid tee waveguide junction, said hybrid tee waveguide junction including a balanced pair of side arm waveguides connecting said single-polarized side port and said transition element, wherein said ortho-mode transducer comprises two halves assembled together to provide said ortho-mode transducer, and wherein said common port is on one of said two halves, said single-polarized back port and said single-polarized side port are on the other of said two halves, and a portion of each of said balanced side arm waveguides is on each of said two halves.

2. The ortho-mode transducer of claim 1, wherein said single-polarized side port comprises an in-phase port of said hybrid tee waveguide junction and wherein said balanced pair of side arm waveguides are looped around in a symmetrical manner to connect said single-polarized side port to opposed sides of said transition element.

3. The ortho-mode transducer of claim 1, wherein said common port comprises a substantially circular port and wherein said single-polarized back port and said single-polarized side port comprise substantially rectangular ports.

4. The ortho-mode transducer of claim 3, wherein said transition element provides a gradual transition from said substantially rectangular single-polarized back port to said substantially circular common port.

5. The ortho-mode transducer of claim 1, wherein one-half of each of said balanced side arm waveguides is on each of said two halves.

6. The ortho-mode transducer of claim 1, wherein signal paths from both said single-polarized back port and said single-polarized side port are symmetrical.

7. The ortho-mode transducer of claim 1, wherein said single-polarized back port and said single-polarized side port are oriented in the same plane.

8. The ortho-mode transducer of claim 1, wherein each of said halves is integrated into a separate component of a microwave system.

9. The ortho-mode transducer of claim 8, wherein one of said halves is integrated with an antenna hub and the other of said halves is integrated with a radio housing.

10. The ortho-mode transducer of claim 1, wherein said ortho-mode transducer is integrated with a feed horn radiator.

11. An ortho-mode transducer comprising:

a common port having a longitudinal axis;

a single-polarized back port having a longitudinal axis;

a transition element connecting said common port and said single-polarized back port, the longitudinal axis of said single-polarized back port being substantially aligned with the longitudinal axis of said common port, said transition element having a length (L) along the direction of the longitudinal axis of the common port;

a single-polarized side port;

a hybrid-tee power divider structure connected to said single-polarized side port; and a balanced pair of waveguides connecting the hybrid-tee power divider structure to said transition element, said balanced pair of waveguides having a width (W) along the longitudinal axis of the common port, wherein W does not exceed L, wherein said ortho-mode transducer comprises two halves which are assembled together to provide said ortho-mode transducer, and wherein said common port is on one of said two halves, said single-polarized back port and said single-polarized side port are on the other of said two halves, and a portion of each of said balanced pair of waveguides is on each of said halves.

12. The ortho-mode transducer of claim 11, wherein said balanced pair of waveguides are looped around in a symmetrical manner to connect to opposed sides of said transition element.

13. The ortho-mode transducer of claim 11, wherein one-half of each of said balanced pair of waveguides is on each of said halves.

14. The ortho-mode transducer of claim 11, wherein signal paths from both said single polarization back port and said single polarization side port are symmetrical.

15. The ortho-mode transducer of claim 11, wherein said single-polarized back port and said single-polarized side port are oriented in the same plane.

16. The ortho-mode transducer of claim 11, wherein said common port comprises a substantially circular port, wherein said single-polarized back port comprises a substantially rectangular port, and wherein said transition element provides a gradual transition from said substantially rectangular single-polarized back port to said substantially circular common port.

17. An ortho-mode transducer comprising:

a common port having a longitudinal axis;

a single-polarized back port having a longitudinal axis;

a transition element connecting said common port and said single-polarized back port, the longitudinal axis of said single-polarized back port being substantially aligned with the longitudinal axis of said common port;

a single-polarized side port; and a hybrid tee waveguide junction connecting said single-polarized side port and said transition element, wherein said ortho-mode transducer further comprises a first transducer part including said common port and a first portion of said hybrid tee waveguide junction, and a second transducer part including said single-polarized back port, said single-polarized side port and a second portion of said hybrid tee waveguide junction; wherein said ortho-mode transducer comprises two haves assembled together to provide said ortho-mode transducer, and wherein said common port is on one of said two halves, said single-polarized back port and said single-polarized side port are on the other of said two halves, and a portion of each of said balanced side arm waveguides is on each of said two halves.

18. The ortho-mode transducer of claim 17, and further including at least one fastener for assembling said first and second transducer parts.

19. The ortho-mode transducer of claim 18, wherein said at least one fastener comprises a plurality of threaded fasteners.

20. The ortho-mode transducer of claim 17, wherein said hybrid tee waveguide junction includes a pair of side arm waveguides that connect said single-polarized side port and said transition element, and wherein said first and second portions of said hybrid tee waveguide junction comprise first and second portions of each of said pair of side arm waveguides.

21. The ortho-mode transducer of claim 20, wherein said first and second portions of each of said pair of side arm waveguides comprises one-half of each of said pair of side arm waveguides.

22. A method for manufacturing an ortho-mode transducer that includes a common port, a single-polarized back port, and a transition element connecting said common port and said single-polarized back port, said method comprising the steps of:

constructing a single-polarized side port and a hybrid tee waveguide junction connecting said single-polarized side port and said transition element;

constructing a first part of said ortho-mode transducer to include said common port and a first portion of said hybrid tee waveguide junction;

constructing a second part of said ortho-mode transducer to include said single-polarized back port, said single-polarized side port and a second portion of said hybrid tee waveguide junction; and assembling said first and second parts of said ortho-mode transducer; wherein said ortho-mode transducer comprises two halves assembled together to provide said ortho-mode transducer, and wherein said common port is on one of said two halves, said single-polarized back port and said single-polarized side port are on the other of said two halves, and a portion of each of said balanced side arm waveguides is on each of said two halves.

23. The method of claim 22, and further including the step of constructing said hybrid tee waveguide junction with a balanced pair of side arm waveguides connecting said single-polarized side port to said transition element, and constructing said first and second portions of said hybrid tee waveguide junction with first and second portions of each of said balanced pair of side arm waveguides.

24. The method of claim 23, and further including the step of forming said first and second portions of each of said balanced pair of side arm waveguides with first and second halves of each of said balanced pair of side arm waveguides.

* * * * *